US005224880A

United States Patent [19]

Schempp

[11] Patent Number: 5,224,880

[45] Date of Patent: Jul. 6, 1993

[54] PRESS-FIT CONNECTOR

[75] Inventor: Otto Schempp, Bad Rappenau, Fed. Rep. of Germany

[73] Assignee: Molex Incorporated, Lisle, Ill.

[21] Appl. No.: 895,582

[22] Filed: Jun. 8, 1992

Related U.S. Application Data

[63] Continuation of Ser. No. 748,985, Aug. 22, 1991, abandoned.

[30] Foreign Application Priority Data

Aug. 22, 1990 [DE] Fed. Rep. of Germany ... 9012095[U]

[51] Int. Cl.[5] ..... H01R 13/428

[52] U.S. Cl. ..... 439/682; 439/751

[58] Field of Search ..... 439/751, 682, 82

[56] References Cited

U.S. PATENT DOCUMENTS 4,017,143 4/1977 Knowles ..... 439/888

4,606,599 8/1986 Grant et al. ..... 439/682

5,035,631 7/1991 Piorunneck et al. ..... 439/108

OTHER PUBLICATIONS

IBM Technical Disclosure Bulletin, "Receptacle", vol. 2, No. 4, Dec. 1959.

*Primary Examiner*—Gary F. Paumen

*Attorney, Agent, or Firm*—A. A. Tirva

[57] ABSTRACT

A connector is disclosed having a plurality of contact elements to be pressed-in into contact holes in a printed circuit board. The contact elements are arranged in a housing of insulating material. In order to press-in all contact elements of the connector simultaneously into the respective contact holes of the circuit board such a large force has to be applied to the housing that the housing may be damaged. The contact elements are elongated to extend up to the top surface of the housing such that the insertion force can be applied directly to the contact elements.

3 Claims, 1 Drawing Sheet

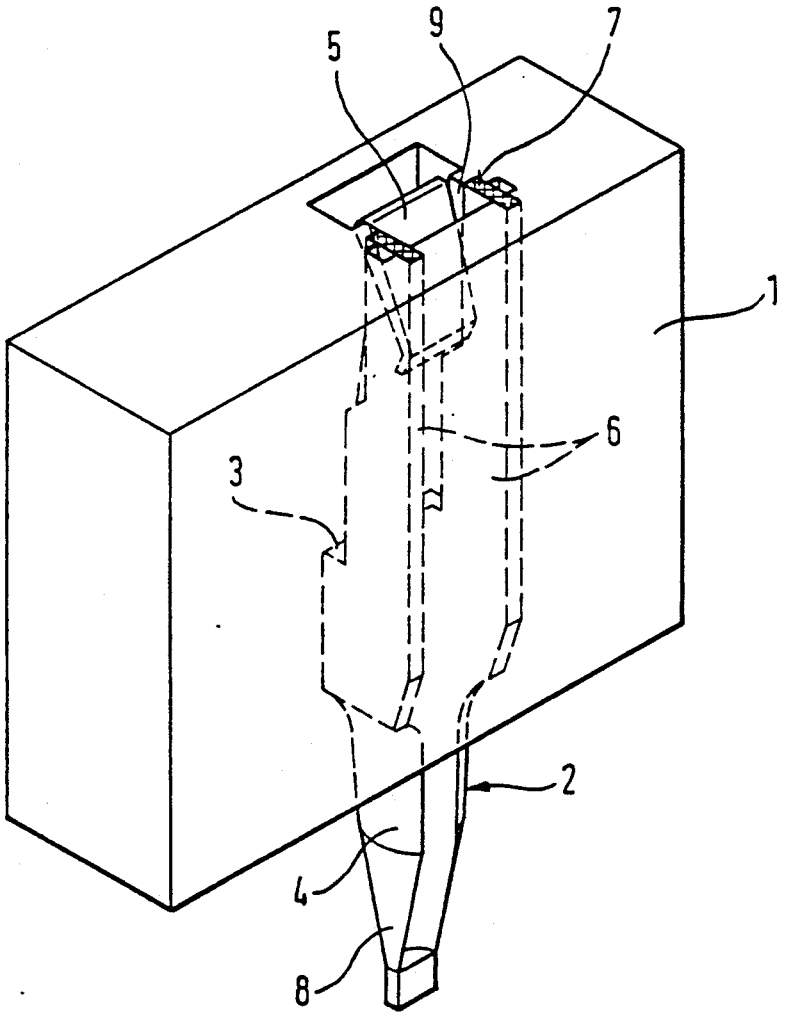
5
9
7
1
6
3
2
4
8

PRESS-FIT CONNECTOR

This is a continuation of copending application Ser. No. 07/748,985 filed on Aug. 22, 1991, now abandoned.

TECHNICAL FIELD

The invention relates to a press-fit connector, in which a pin-like contact elements are mounted in an insulating plastic body of the connector with projecting press-in contact portions of the elements extending from the bottom side of the connector.

BACKGROUND OF THE INVENTION

Multi-contact press-fit connectors, for example with 48 or 96 contact pins closely spaced in several rows and arranged in a matrix which then is used to establish plugable connections in predrilled and through-plated holes of a printed circuit board, are well known in the art. As a single press-fit contact element, the so-called C-PRESS solderless contact has become particularly well known. The C-press contact was first disclosed in U.S. Pat. No. 4,017,143, the disclosure of which is incorporated herein by reference. This contact ensures by its resiliently yielding C-shaped contact region, good contact with substantially uniform bearing pressure over the entire contact region.

A problem exists in the insertion of all the contacts of the multi-contact connector simultaneously into the respective holes of the printed circuit board. A high insertion force has to be applied to the connector housing in which the contact elements are held. Since the housings are generally made of plastic, without special precautionary measures, rupturing of the housing and/or deformations of the contact elements may occur.

Presently the insertion of such press-fit connectors requires a tool which is inserted into the connector housing via an opening running parallel to the contact element to engage a shoulder formed on the contact element located inside the connector housing. The tool may also be adapted such that at the same time it also engages the upper surface of the connector housing. The insertion force is applied to t he contact and to the housing.

If an insertion force is applied via a flat tool only to the upper surface of the housing, it is essential that the contact elements engage the insulating connector body over sufficiently large areas in order to be able to transfer the required forces. Such a large anchoring area of the contact element inside the insulating body is, however, at odds with the requirement for ever greater miniaturization of such connectors. Furthermore, in spite of the large anchoring area of the contact elements in the connector housing, rupturing of the housing may still occur.

SUMMARY OF THE INVENTION

An object of the invention is to improve a multiple contact press-fit connector to prevent rupturing of the connector housing during the connector pressing-in operation.

In accordance with the invention, at least one section of the contact element anchored in the connector housing is extended up to the upper surface of the connector housing opposite the press-fit contact surface and terminated preferably flush with the upper surface of the connector housing.

BRIEF DESCRIPTION OF THE DRAWING

The invention and advantageous details are explained in more detail below with reference to the drawing. The single FIGURE shows a single contact in an insulating body, i.e. the connector housing which may be adapted to house a plurality of contact elements.

DETAILED DESCRIPTION

A pin like contact element 2 of the present invention is shown diagrammatically in the sole FIGURE having an upper section including two substantially parallel arms 6, a middle section connecting the two arms 6 and including an upper shoulder 3 and a lower section having a C-shaped cross section 4 terminating in a tapered conical portion 8. The contact 2 is anchored via an interference fit within an opening 9 of an insulating connector housing 1 having a top surface 10 and a bottom surface 11. It is understood that housing 1 may contain a plurality of openings 9 to house multiple contact elements 2.

As in the case of prior art press-fit connectors of such type, the contact element 2 is inserted into the opening 9 by application of an insertion tool (not shown) to the shoulder 3, and is held within the housing 1 by interference developed between the contact element, and the walls of opening 9. The contact element 2 is positioned within the housing 1 such that the C-shaped section extends from the bottom surface 11 of the housing 1. In accordance with the invention, the length of each arm 6 is made so that end surfaces 7 of each arm are flush with the top surface 10 of the connector housing 1. Extension of the arms 6 to the top surface 10 allows for application of a flat insertion tool (not shown) to the top surface 10 of the housing 1 for insertion of the contact elements into the board. With such an arrangement, the insertion force applied by a flat tool is transferred via arms 6 to each contact element 2 such that contact anchoring areas within the openings 9 of the housing are not subjected to the insertion forces applied by the tool to the connector housing.

What is claimed is:

1. A press-fit electrical connector for mounting on a printed circuit board having at least one aperture therein, the connector comprising:

a housing having top and bottom surfaces and at least one contact receiving cavity extending between the top and bottom surfaces, an electrical contact located within the cavity, the contact including an intermediate portion in an interference fit with the housing, a press-fit section extending from one end of the intermediate portion and projecting from the bottom surface of the connector housing, the press-fit section adapted, for engaging the aperture on the printed circuit board, at least one rigid arm extending from the other end of the intermediate portion of the contact, the arm terminating in a surface which is flush with the top surface of the connector housing, whereby a connector insertion force applied to the top surface of the housing to force the press-fit section into the aperture in the printed circuit board is transmitted directly via the arm to the press-fit section, and wherein the intermediate portion includes a U-shaped section having a bottom wall and two sidewalls and wherein the bottom wall of the U-shaped section includes a shoulder allowing for a contact insertion force to be applied to the contact.

2. A connector in accordance with claim 1, wherein one said arm extends from one said sidewall and another substantially identical and parallel said arm extends from the other sidewall.

3. A connector in accordance with claim 2, wherein the press-fit section extends from the U-shaped section and terminates in a C-shaped cross-section.

* * * * *